United States Patent [19]

Freeland

[11] Patent Number: 4,516,688

[45] Date of Patent: May 14, 1985

[54] CLOSURE CAP HAVING INTEGRATED FASTENING MEANS

[75] Inventor: Warwick P. Freeland, Mount Waverley, Australia

[73] Assignee: W. A. Deutsher Proprietary Limited, Moorabbin, Australia

[21] Appl. No.: 583,568

[22] Filed: Feb. 27, 1984

[51] Int. Cl.[3] ..... B65D 41/06

[52] U.S. Cl. ..... 220/293; 220/295

[58] Field of Search ..... 220/293, 295, 298, 302, 220/DIG. 32, DIG. 33; 215/356

[56] References Cited

U.S. PATENT DOCUMENTS 4,020,970 5/1977 Koscik et al. ..... 220/302

*Primary Examiner*—George T. Hall

*Attorney, Agent, or Firm*—J. R. Halvorsen; T. W. Buckman

[57] ABSTRACT

A one-piece closure cap formed of a plastics material and being adapted to close an opening in a receptacle or container and to be releasably locked in the closed position through a bayonet-type connection. The cap has a cylindrical body section which fits within the opening and an enlarged head section at one end of the body section. Locking lugs formed integral with the body section extend radially outwards therefrom and each is connected to the body section through a resilient strap-like portion partially separated from the body section by two slots extending circumferentially of the body section and being spaced apart in the axial direction of that section. Each lug is formed integral with the respective strap-like portion so as to be located between the ends thereof and is movable relative to the body section in the axial direction of that section. That movement occurs through flexing of the strap-like portion and is limited by engagement between the longitudinal edges of the strap-like portion and the opposed edges of the respective slot.

12 Claims, 11 Drawing Figures

CLOSURE CAP HAVING INTEGRATED FASTENING MEANS

This invention relates to closure caps for hollow receptacles and containers. One particular use of such a cap is for closing the oil filler opening in the rocker cover of a motor vehicle engine, and it will be convenient to hereinafter describe the invention with reference to that particular example application.

Oil filler caps are generally made of metal and comprise a plurality of components including springs and gaskets. Such caps are therefore of relatively complex and expensive construction.

It is an object of the present invention to provide a closure cap of the general kind discussed above, which is of relatively simple and inexpensive construction and which is effective in operation.

According to the present invention there is provided a closure cap for closing an opening in a hollow receptacle or container including, a body section which is insertable into said opening, an englarged head section at one end of the body section and formed integral therewith, at least one locking lug which is receivable in a cooperable recess provided in or adjacent said opening, and connecting means formed integral with both said lug and one of said sections and connecting said lug to said one section so as to permit relative movement therebetween.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Figure 1:
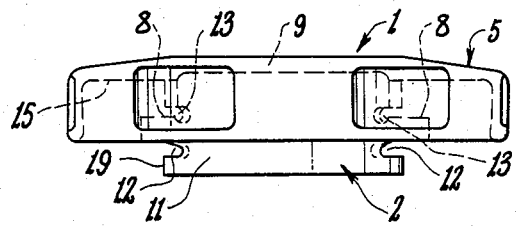
FIG. 1 is a side elevational view of a closure cap according to one embodiment of the invention.
Figure 2:
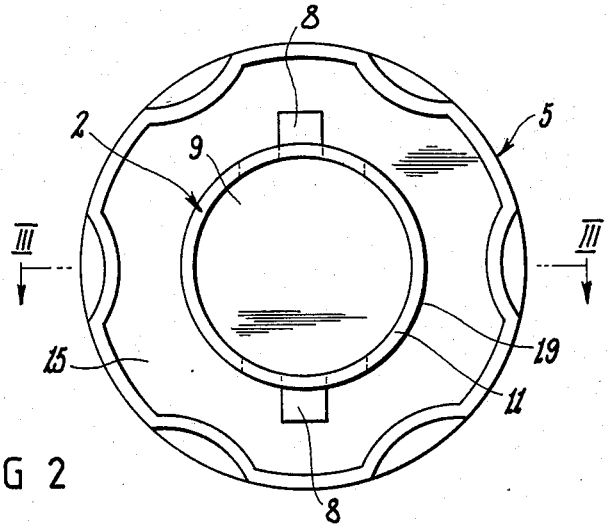
FIG. 2 is an underneath plan view of the cap shown in FIG. 1.
Figure 3:
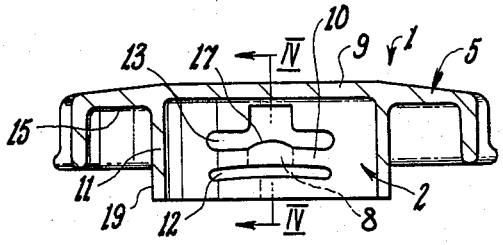
FIG. 3 is a cross-sectional view taken along line III—III of FIG. 2.
Figure 4:
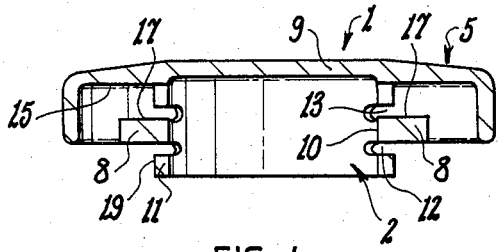
FIG. 4 is a cross-sectional view taken along line IV—IV of FIG. 3.

One form of oil filler cap 1 incorporating the invention is shown in FIGS. 1 to 4 and includes a hollow cylindrical body section 2 which is insertable into the oil filler opening 3 of a rocker cover 4 (FIGS. 7 to 11), and an enlarged head section 5 at one end of that body section 2. Integral locking means are provided on the body section 2, but in an alternative arrangement hereinafter described such means may be provided on the head section 5.

In a typical arrangement, the oil filler cap 1 and rocker cover 4 cooperate through a bayonet connection. The male part of that connection is provided by the cap 1 and the part of the rocker cover 4 defining the oil filler opening 3 forms the female part. According to the arrangement shown in FIGS. 7 to 11, the mouth of the filler opening 3 is defined by an annular flange 6 and the undersurface 7 of that flange 6 forms part of the bayonet connection.

The aforementioned locking means preferably comprises a pair of lugs 8 each of which projects laterally outwards from the outer surface 19 of the body section 2. It is generally convenient to locate the lugs 8 in diametrically opposed relationship, but other arrangements can be adopted and the number of lugs 8 may be varied. Each lug 8 is arrange so as to be capable of limited deflection in the axial direction of the body section 2 for reason hereinafter made clear, and that facility is achieved through the connection between the lug 8 and the main part of the body section 2. Furthermore each lug 8 is spaced axially from an end wall 9 of the head section 5 so that the head section 5 and lug 8 can be located on respective opposite sides of the oil filler flange 6.

In the preferred construction shown, each lug connection 10 is flexible in the axial direction of the body section 2 and through that flexibility allows the desired deflection of the locking lug 8. The particular connection 10 as shown comprises a strap-like portion of the wall 11 of the body section 2. That portion 10 is partially separated from the main part of the body section 2 by two slots 12 and 13 which are spaced in the axial direction of the body section 2 and extend circumferentially of that section 2. The lug 8 is formed integral with the strap-like portion 10 and may be located substantially midway in the length of that portion 10. The length of the strap-like portion 10 can be selected to suit requirements and the ends of that portion 10 remain connected to the main part of the body section 2.

The width of the slots 12 and 13 determines the maximum extent of deflection of the locking lug 8 and in the case of the lower slot 12 at least, that width is preferably selected to avoid over-stressing of the strap-like portion 10. Furthermore, each strap-like portion 10 may slope or curve downwardly on each side of the locking lug 8 so as to minimize the possibility of the strap-like portion 10 collapsing or remaining in a downwardly deflected position. In that regard, the downward direction is the direction away from the end wall 9 of the head section 5.

Figure 7:
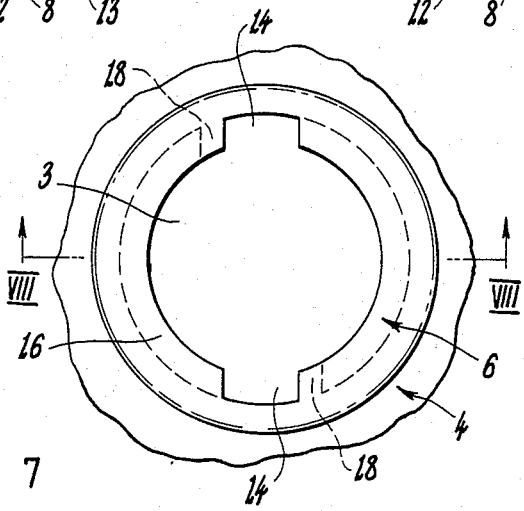
FIG. 7 is a plan view of portion of the rocker cover of a motor vehicle engine.
Figure 8:
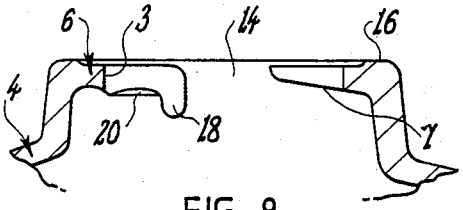
FIG. 8 is a cross-sectional view taken along line VIII—VIII of FIG. 7.

In order that the cap 1 can be received in the oil filler opening 3, the flange 6 surrounding that opening 3 is provided with a pair of recesses 14 having a shape substantially complementary to that of the locking lugs 8 (see FIG. 7).

When the lugs 8 are moved into the opening 3 through the recesses 14, an abutment surface 15 associated with the cap head section 5 is brought into engagement with the upper surface 16 of the opening flange 6. At that position of the cap 1, the upper side 17 of each lug 8 is substantially aligned with the under-surface 7 of the opening flange 6. It is preferred that a stop 18 projects downwardly from one side of each flange recess 14 so as to prevent turning movement of the cap 1 in one direction from the aforementioned position (FIGS. 7 to 11).

Figure 9:
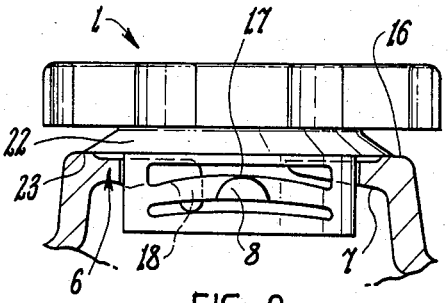
FIG. 9 is a view similar to FIG. 8 but showing the cap of FIG. 6 inserted into the rocker cover opening.
Figure 10:
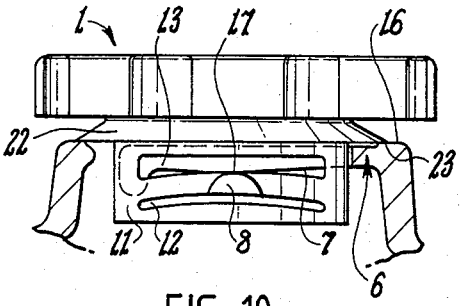
FIGS. 10 and 11 are view similar to FIG. 9 but showing the cap progressively rotated into the locked condition, and for convenience of illustration the rocker cover is shown as rotated relative to the cap.
Figure 11:
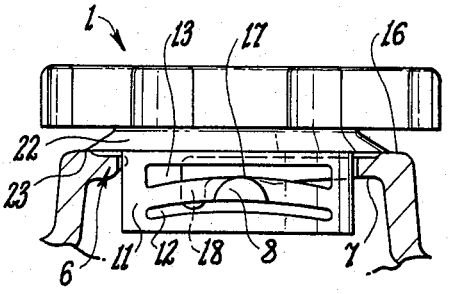

Each lug 8 may have a curved or sloping upper side 17 to facilitate movement onto the flange undersurface 7. That under-surface 7 may also slope or be curved so that there is a progressive downward deflection of the cooperating lug 8 as the cap is turned to traverse the lug 8 across the flange under-surface 7. A shallow locking recess 20 (FIG. 8) may be provided in that undersurface 7 at an appropriate position, and in a preferred arrangement the lug 8 reaches its maximum deflection just prior to moving into alignment with the locking recess 20 (FIGS. 9 to 11). The lug 8 therefore suddenly snaps into the recess 20 under the influence of its flexible connection 10 and thereby firmly retains the cap 1 in its closing position. At that position, some deflection of the lug 8 may remain and the stop 18 prevents turning movement of the cap 1 beyond that position.

Removal of the cap 1 is effected by reverse rotation and the shape of the lugs 8 and/or flange under-surface 7 enables the lugs 8 to be ramped out of their respective locking recesses 20. Any suitable hand engaging feature may be provided on the cap head section 5 to facilitate rotation of the cap 1.

Figure 5:
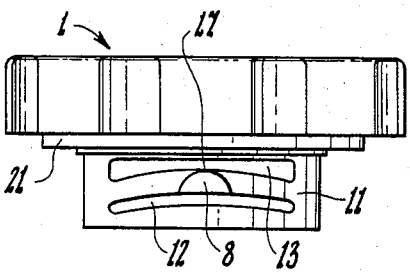
FIG. 5 is a view similar to FIG. 1 but showing a slightly modified form of closure cap.

Instead of relying on the abutment surface 15 for engagement with the rocker cover surface 16, a rubber or other resilient sealing gasket 21 may be arranged to be clamped between the head section 5 of the cap 1 and the surface 16 (see FIG. 5). Alternatively, as shown in FIG. 6, a sealing element 22 may be formed integral with the cap 1.

Figure 6:
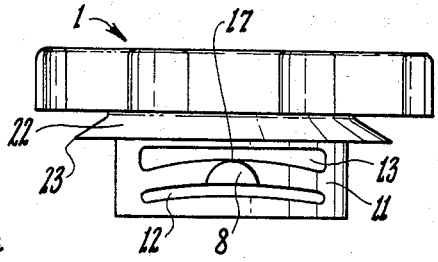
FIG. 6 is a view similar to FIG. 1 showing yet another form of closure cap.

In the example of FIG. 6, a flexible sealing element or flange 22 is formed integral with the body section 2 of the cap 1, but it could be formed integral with the head section 5 if desired. As shown, such a flange 22 may slope in a direction outwards of the body section 2 and away from the head section 5. It is further preferred that the flange 22 decreases in thickness towards its outer edge 23 so as to provide a relatively thin lip which will deflect on engagement with the opposed surface 16 of the opening flange 6 (FIG. 11).

It will be apparent from the foregoing description that the present invention provides a simple yet effective closure cap which is particularly suited for use as an automobile filler cap. The cap described is open to substantial variation without departing from the basic concept of the invention.

For example, in an alternative construction the locking lugs may be provided on the head section of the cap rather than on the cylindrical body section. In such an arrangement the head section may have an axial skirt portion which fits around a cylindrical projection containing the opening to be closed by the cap. Inwardly projecting lugs formed on the inner surface of that skirt portion may cooperate with recesses and camming surfaces of the cylindrical projection in the same manner as previously described.

Various alterations, modifications and/or additions may be introduced into the constructions and arrangements of parts previously described without departing from the spirit or ambit of the invention as defined by the appended claims.

I claim:

1. A one-piece plastics material closure cap for closing an opening in a hollow receptacle or container including, a cylindrical body section which is insertable into said opening, an enlarged head section at one end of the body section and formed integral therewith, a plurality of locking lugs provided on said body section in circumferentially spaced relationship and each projecting radially outwards from said body section, resilient means connecting each said locking lug to said body section aand being formed integral with both said body section and the respective said lug, said resilient means allowing movement of the respective said locking lug relative to said body section in the axial direction of said body section, and stop means limiting the extent of said relative movement so as to prevent over-stressing of said resilient means.

2. A closure cap according to claim 1, wherein said body section is hollow, each said resilient means is a strap-like portion partially separated from said body section and having its longitudinal axis extending generally circumferentially of said body section, said partial separation being such that the ends of said strap-like portion remain connected to said body section, and each said lug is connected to the respective said strap-like portion intermediate the ends thereof.

3. A closure cap according to claim 2, wherein each said strap-like portion is separated from the remainder of said body section by two slots spaced apart in the axial direction of the body section and extending generally circumferentially thereof, and said stop means is formed by the sides of said slots opposed to adjacent longitudinal edges of the respective said strap-like portion.

4. A closure cap according to claim 1, wherein the surface of the or each said lug adjacent said one end of the body section has a convex curvature.

5. A closure cap according to claim 1, wherein an integral flexible sealing flange is provided adjacent said one end of the body section and surrounds said body section so as to be engageable with a surface of the receptacle or container surrounding the opening thereof.

6. A closure cap according to claim 5 wherein said flange decreases in thickness towards an outer edge thereof to provide a relatively thin lip which will deflect upon engagement with said receptacle or container surface.

7. A closure cap for closing an opening in a hollow receptacle or container including, a body section which is insertable into said opening, and enlarged head section at one end of the body section and formed integral therewith, at least one locking lug which is receivable in a co-operable recess provided in or adjacent said opening, and connecting means formed integral with both said lug and one of said sections and connecting said lug to said one section so as to permit relative movement therebetween, said body section constituting said one section and being in the form of a hollow cylinder, said connecting means including a strap-like portion partially separated from said body section and having its longitudinal axis extending generally circumferentially of said body section, said partial separation being such that the ends of said strap-like portion remain connected to said body section, and said lug is connected to the said strap-like portion intermediate the ends thereof so as to project radially outwards from the outer cylindrical surface of said body section.

8. A closure cap according to claim 7, wherein said body is moulded in one piece from a plastics material.

9. A closure cap according to claim 7, wherein two said lugs are provided on respective and opposite sides of the said cap.

10. A closure cap according to claim 7, wherein said body section is a cylindrical member and said relative movement is in the axial direction of that member.

11. A closure cap according to claim 7, wherein said strap-like portion is separated from the remainder of said body section by two slots spaced apart in the axial direction of said body section and extending generally circumferentially thereof.

12. A closure cap according to claim 11, wherein at least one of said slots slopes or curves away from said one end of the body section on each side of the lug.

* * * * *